US012024871B2

(12) United States Patent
Lian et al.

(10) Patent No.: US 12,024,871 B2
(45) Date of Patent: Jul. 2, 2024

(54) MECHANICAL CONTROL LOGIC ACTUATOR FOR VACUUM TOILET

(71) Applicant: CHINA JILIANG UNIVERSITY, Hangzhou (CN)

(72) Inventors: Jiadi Lian, Hangzhou (CN); Jing Xu, Hangzhou (CN); Bifeng Chen, Hangzhou (CN); Jiayu Lian, Hangzhou (CN); Yifei Zhang, Hangzhou (CN)

(73) Assignee: CHINA JILIANG UNIVERSITY, Hangzhou (CN)

( * ) Notice: Subject to any disclaimer, the term of this patent is extended or adjusted under 35 U.S.C. 154(b) by 218 days.

(21) Appl. No.: 17/849,738

(22) Filed: Jun. 27, 2022

(65) Prior Publication Data

US 2023/0160192 A1 May 25, 2023

(30) Foreign Application Priority Data

Nov. 20, 2021 (CN) ..... 202111380972.4

(51) Int. Cl.
*E03D 5/02* (2006.01)
*E03F 1/00* (2006.01)

(52) U.S. Cl.
CPC ..... *E03D 5/024* (2013.01); *E03F 1/006* (2013.01)

(58) Field of Classification Search
CPC ..... E03D 5/024; E03D 5/02; E03F 1/006
USPC ..... 4/300
See application file for complete search history.

(56) References Cited

U.S. PATENT DOCUMENTS 4,357,719 A * 11/1982 Badger ..... E03F 1/006 4/316
4,713,847 A 12/1987 Oldfelt et al.
4,819,279 A * 4/1989 Sigler ..... E03F 1/006 4/300
5,604,938 A * 2/1997 Tyler ..... E03F 1/006 4/321

(Continued)

FOREIGN PATENT DOCUMENTS

CN 2432267 Y 5/2001
CN 1334385 A 2/2002

(Continued)

OTHER PUBLICATIONS

Chinese First Office Action, Chinese Application No. 202111380972.4, mailed Jul. 5, 2023.

*Primary Examiner* — Huyen D Le

(57) ABSTRACT

A mechanical control logic actuator for a vacuum toilet includes: a pneumatic valve assembly configured to control an air path of the vacuum toilet and a sewage tank; a vacuum tank configured to provide vacuum compensation for the sewage tank; a first pressure tank configured to provide a power source for the pneumatic valve assembly; a second pressure tank configured to feed gas into the sewage tank; and a sewage pipe configured to discharge sewage in the sewage tank; wherein the first pressure tank controls the air path to be in a circulation state or in a cut-off state through the pneumatic valve assembly, the vacuum tank provides vacuum compensation for the sewage tank, the sewage in the toilet is pumped into the sewage tank, the second pressure tank feeds gas into the sewage tank, the sewage tank is pressurized and the sewage is discharged through the sewage pipe.

11 Claims, 2 Drawing Sheets

(56) References Cited

U.S. PATENT DOCUMENTS

| | | | | |
|---|---|---|---|---|
| 6,085,366 | A * | 7/2000 | Pondelick | E03D 5/024 4/321 |
| 6,216,285 | B1 * | 4/2001 | Olin | E03F 1/006 4/321 |
| 9,701,410 | B2 * | 7/2017 | Boodaghians | E03D 5/003 |

FOREIGN PATENT DOCUMENTS

| | | | |
|---|---|---|---|
| CN | 105276224 | A | 1/2016 |
| CN | 109024808 | A | 12/2018 |
| CN | 209467140 | U | 10/2019 |
| CN | 111287297 | A | 6/2020 |
| EP | 0584031 | A2 | 2/1994 |
| GB | 1603871 | A | 12/1981 |
| WO | 2011012459 | A1 | 2/2011 |

* cited by examiner

MECHANICAL CONTROL LOGIC ACTUATOR FOR VACUUM TOILET

CROSS REFERENCE TO RELATED APPLICATIONS

The present application claims foreign priority of Chinese Patent Application No. 202111380972.4, filed on Nov. 20, 2021, the entire contents of which are hereby incorporated by reference in their entireties.

TECHNICAL FIELD

The present disclosure relates to a mechanical control logic actuator for a vacuum toilet, which is free from electric.

BACKGROUND

With the development of the society, vacuum drainage technology has been widely used in railway, construction, ships, aircraft, municipal and other occasions at present. Vacuum drainage technology has the characteristics of water saving, sanitation, small pipe diameter, flexible layout, and so on.

However, the vacuum toilet in the related art is generally controlled by electric control valve. It is easy to cause the loss of electric energy, although the control accuracy is high. Because the environment of a toilet is generally humid, the using of the electric control valve is easy to cause electric leakage, and easy to damage the toilet, therefore, potential risk exists, and the manufacturing and maintenance costs are high.

SUMMARY OF THE DISCLOSURE

The present disclosure provides a mechanical control logic actuator for a vacuum toilet, which is free from electric. The mechanical control logic actuator could not only realize a secondary flushing of the toilet, but also reduce environmental influences such as humidity and temperature since using pneumatic control. Furthermore, the mechanical control logic actuator could reduce the manufacturing cost and maintenance cost, and has strong practicability.

In order to solve the above technical problems, the present disclosure adopts technology programs as follows.

A mechanical control logic actuator for a vacuum toilet, which is free from electric, includes: a pneumatic valve assembly, configured to control an air path of the vacuum toilet and a sewage tank; a vacuum tank, configured to provide vacuum compensation for the sewage tank; a first pressure tank, configured to provide a power source for the pneumatic valve assembly; a second pressure tank, configured to feed gas into the sewage tank; and a sewage pipe, configured to discharge sewage in the sewage tank; wherein the first pressure tank controls the air path to be in a circulation state or in a cut-off state through the pneumatic valve assembly, the vacuum tank provides vacuum compensation for the sewage tank, the sewage in the vacuum toilet is pumped into the sewage tank, the second pressure tank feeds gas into the sewage tank, the sewage tank is pressurized and the sewage is discharged through the sewage pipe, such that the vacuum toilet flushes and drains automatically.

In some embodiments, a water valve is provided between water source and the vacuum toilet, the water valve is communicated with the pneumatic valve assembly, and is controlled by the pneumatic valve assembly, such that the vacuum toilet flushes.

In some embodiments, a pinch valve is provided between the sewage valve and the vacuum toilet, the pinch valve is communicated with pneumatic valve assembly, and is controlled by the pneumatic valve assembly, such that the sewage in the vacuum toilet is pumped into the sewage tank.

In some embodiments, the pneumatic valve assembly comprises a mechanical valve, a second pneumatic valve, a third pneumatic valve, a fourth pneumatic valve, a fifth pneumatic valve, a sixth pneumatic valve, a seventh pneumatic valve, an eighth pneumatic valve, a ninth pneumatic valve, and a tenth pneumatic valve, an eleventh pneumatic valve, and a twelfth pneumatic valve; the first pressure tank is communicated with the mechanical valve, the second pneumatic valve, the seventh pneumatic valve, and the tenth pneumatic valve; the mechanical valve is communicated with the second pneumatic valve; the seventh pneumatic valve is communicated with the pinch valve; the tenth pneumatic valve is communicated with the eleventh pneumatic valve; the eleventh pneumatic valve is disposed in the sewage pipe; the second pneumatic valve is communicated with the fourth pneumatic valve, the third pneumatic valve, and the eighth pneumatic valve; the fourth pneumatic valve is communicated with the fifth pneumatic valve; the fifth pneumatic valve is communicated with the third pneumatic valve, the seventh pneumatic valve, the sixth pneumatic valve, the ninth pneumatic valve, and the twelfth pneumatic valve; and the ninth pneumatic valve is communicated with the second pneumatic valve.

In some embodiments, the third pneumatic valve is communicated with the water valve, and is configured to control the water source.

In some embodiments, the vacuum tank is communicated with the sewage tank through the eighth pneumatic valve. The vacuum tank may define a runner therein, which may have a function of buffer, and a function of providing vacuum compensation quickly for the sewage tank when the system is reset, so as to quickly prepare for a second use.

In some embodiments, the second pressure tank is communicated with the sewage tank through the twelfth pneumatic valve. The twelfth pneumatic valve could control gas in the second pressure tank to enter the sewage tank, so as to meet the sewage discharge requirements of sewage tank. A pressure releasing time of the second pressure tank could be controlled by the twelfth pneumatic valve, so as to control the volume of the gas entering in the sewage tank.

In some embodiments, the fourth pneumatic valve is coupled to a first regulating valve.

In some embodiments, the sixth pneumatic valve is coupled to a second regulator.

In some embodiments, the ninth pneumatic valve is coupled to a third regulating valve.

In some embodiments, the pinch valve includes a connecting part and a rubber sleeve; the connecting part defines a channel and an air chamber, the channel has a first port and a second port opposite to the first port; the air chamber is around the channel and communicated with the channel; and the rubber sleeve is arranged in the air chamber and separates the air chamber from the channel; when the pinch valve is in a normal state, the first port is communicated with the second port; when air pressure in the air chamber increases, the rubber sleeve expands to block the channel, and the first port is disconnected from the second port.

BRIEF DESCRIPTION OF THE DRAWINGS

The present disclosure will be further described below with reference to the accompanying drawings.

DETAILED DESCRIPTION

It should be noted that the features in the embodiments of the present disclosure could be combined with each other in the case of an unable conflict. The present disclosure will be described in detail below with reference to the accompanying drawings.

In order to make those skilled in the art better understand the solutions of the present disclosure, the technical solutions in the embodiments of the present disclosure will be clearly and completely described below with reference to the accompanying drawings in the embodiments of the present disclosure. Obviously, the described embodiments are only some embodiments of the present disclosure, not all embodiments. Based on the embodiments of the present disclosure, all other embodiments obtained by persons of ordinary skilled in the art without creative efforts shall fall within the protection scope of the present disclosure.

It should be noted that the terms "first", "second" and the like in the description and claims of the present disclosure and the above drawings are used to distinguish similar objects, and are not necessarily used to describe a specific sequence or sequence. Furthermore, the terms "comprising" "including" and "having", and any variations thereof, are intended to cover non-exclusive inclusion.

Figure 1:
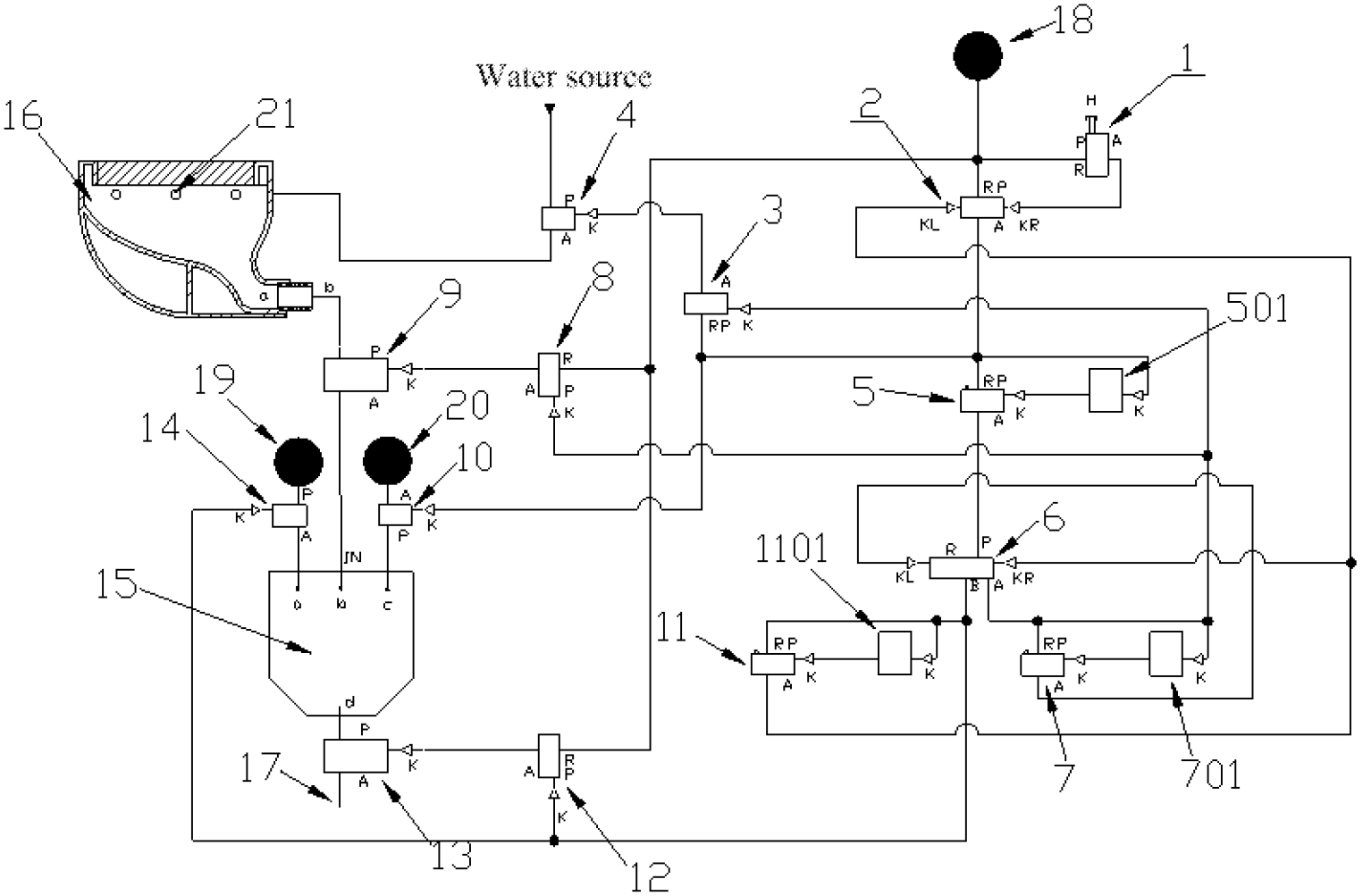
FIG. 1 is a flow chart of a mechanical control logic actuator for a vacuum toilet, which is free from electric, according to some embodiments of the present disclosure.
Figure 2:
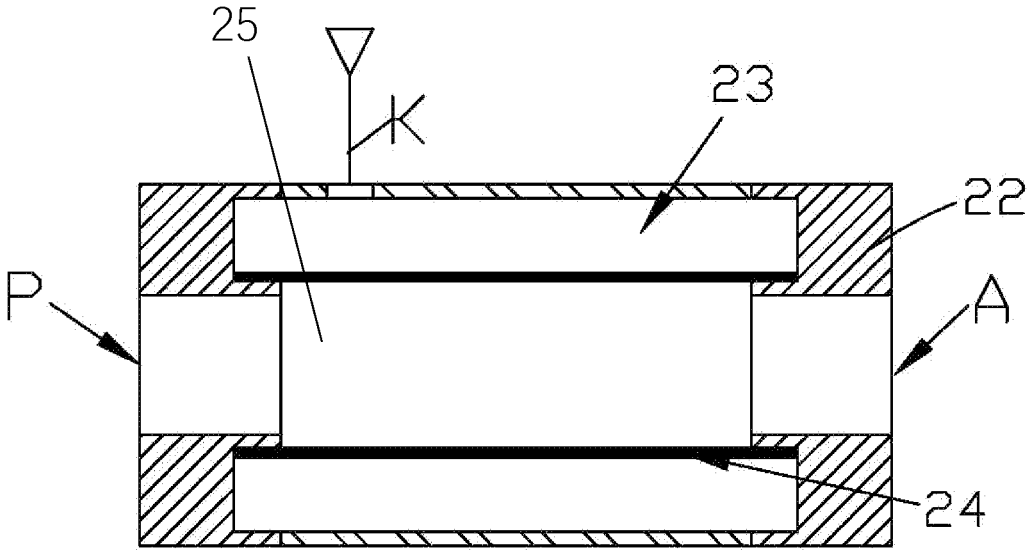
FIG. 2 is a structural schematic view of a pinch valve according to some embodiments of the present disclosure, wherein the pinch valve is in a through flow position.
Figure 3:
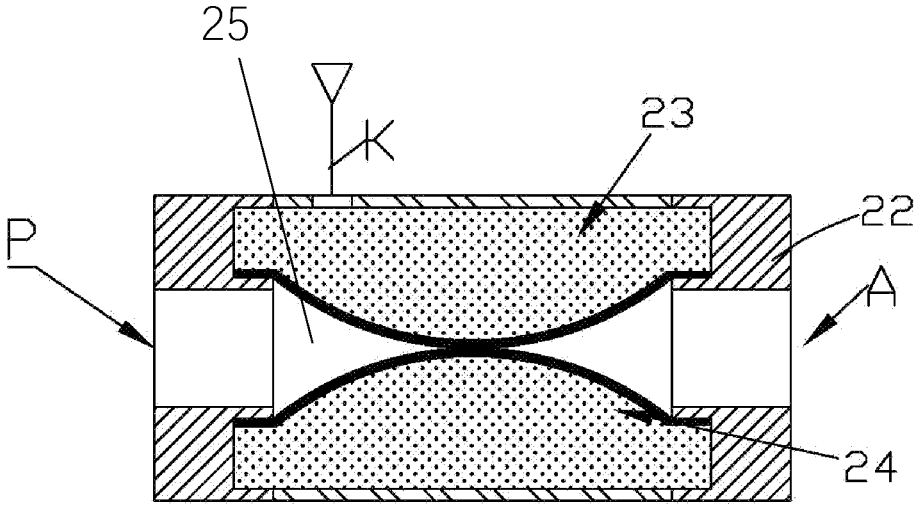
FIG. 3 is a structural schematic view of the pinch valve according to some embodiments of the present disclosure, wherein the pinch valve is in a blocking position.

Referring to FIGS. 1 to 3, a mechanical control logic actuator for a vacuum toilet 16 of the present disclosure, which is free from electric, may include a pneumatic valve assembly, a vacuum tank 20, a first pressure tank 18, a second pressure tank 19 and a sewage pipe 17, the connecting relationship of which may be described below. A pinch valve 9 is provided between the toilet 16 and a sewage tank 15.

The pneumatic valve assembly may be configured to control an air path of the vacuum toilet 16 and the sewage tank 15. For example, the pneumatic valve assembly could control the air path between the vacuum toilet 16 and the sewage tank 15 to switch between a through flow position or a blocking position. The pneumatic valve assembly may include a mechanical valve 1, a second pneumatic valve 2, a third pneumatic valve 3, a fourth pneumatic valve 5, a fifth pneumatic valve 6, a sixth pneumatic valve 7, a seventh pneumatic valve 8, an eighth pneumatic valve 10, a ninth pneumatic valve 11, and a tenth pneumatic valve 12, an eleventh pneumatic valve 13, and a twelfth pneumatic valve 14. The first pressure tank 18 may be communicated with the mechanical valve 1, the second pneumatic valve 2, the seventh pneumatic valve 8 and the tenth pneumatic valve 12. The mechanical valve 1 may be communicated with the second pneumatic valve 2. The seventh pneumatic valve 8 may be communicated with the pinch valve 9. The tenth pneumatic valve 12 may be communicated with the eleventh pneumatic valve 13. The eleventh pneumatic valve 13 may be disposed in the sewage pipe 17. The second pneumatic valve 2 may be communicated with the fourth pneumatic valve 5, the third pneumatic valve 3 and the eighth pneumatic valve 10. The third pneumatic valve 3 may be communicated with a water valve 4, and be configured to control water source, so as to meet the requirements of flushing of the toilet 16. The vacuum tank 20 may be communicated with the sewage tank 15 through the eighth pneumatic valve 10. The eighth pneumatic valve 10 could control a path between the vacuum tank 20 and the sewage tank 15 to be in a through flow position or in a blocking position. The vacuum tank 20 may be configured to provide vacuum compensation for the sewage tank 15. Furthermore, the vacuum tank 20 may define a runner therein, which may have a function of buffer, and a function of providing vacuum compensation quickly for the sewage tank 15 when the system is reset, so as to quickly prepare for a second use.

The fourth pneumatic valve 5 may be communicated with the fifth pneumatic valve 6. The fourth pneumatic valve 5 may be coupled to a first regulating valve 501. The first regulating valve 501 may be configured to adjust a turn-on time of the fourth pneumatic valve 5, that is, the time that the fourth pneumatic valve 5 is in a through flow position. A regulating time of the first regulating valve 501 may range from 0.5 s to 20 s. The regulating time could be adjusted according to pressure of the water source. When the water source have a higher pressure, the regulating time of the first regulating valve 501 may be shorter; when the water source have a lower pressure, the regulating time of the first regulating valve 501 may be longer. Time of pumping water could be set according to practical needs.

The fifth pneumatic valve 6 may be communicated with the third pneumatic valve 3, the seventh pneumatic valve 8, the sixth pneumatic valve 7, the ninth pneumatic valve 11 and the twelfth pneumatic valve 14. The second pressure tank 19 may be communicated with the sewage tank 15 through the twelfth pneumatic valve 14. The twelfth pneumatic valve 14 could control gas in the second pressure tank 19 to enter the sewage tank 15, so as to meet the sewage discharge requirements of sewage tank 15. The sixth pneumatic valve 7 may be connected to a second regulating valve 701, which could regulate a turn-on time of the sixth pneumatic valve 7, that is, the time that the sixth pneumatic valve 7 is in a through flow position. An regulating time of the second regulating valve 701 may range from 2.0 s to 3.0 s.

The ninth pneumatic valve 11 may be communicated with the second pneumatic valve 2, and be coupled to a third regulating valve 1101, such that the third regulating valve 1101 could regulate a turn-on time of the ninth pneumatic valve 11. The turn-on time may be time that the ninth pneumatic valve 11 in a through flow position. Regulating time of the third regulating valve 1101 may range from 2.0 s to 3.0 s.

The pneumatic valve assembly including the mechanical valve 1, the second pneumatic valve 2, the third pneumatic valve 3, the fourth pneumatic valve 5, the fifth pneumatic valve 6, the sixth pneumatic valve 7, the seventh pneumatic valve 8, the eighth pneumatic valve 10, the ninth pneumatic valve 11, and the tenth pneumatic valve 12, the eleventh pneumatic valve 13, and the twelfth pneumatic valve 14 could realize controlling of the toilet 16 when the toilet 16 is in different working conditions. In this way, it is not only conducive to reducing the waste of water resources, but also flexible and convenient to control.

The vacuum tank 20 is configured to provide vacuum compensation for the sewage tank 15. The first pressure tank 18 may be configured to provide a power source for the pneumatic valve assembly. The second pressure tank 19 may be configured to feed gas into the sewage tank 15. The sewage pipe 17 may be configured to discharge sewage in the sewage tank 15. The first pressure tank 18 may control the air path to be in a circulation state or in a cut-off state through the pneumatic valve assembly, such that the vacuum tank 20 could provide vacuum compensation for the sewage tank 15. The sewage in the toilet 16 could be pumped into the sewage tank 15, the second pressure tank 19 may feed gas into the sewage tank 15, and the sewage tank 15 could pressurized and the sewage could be discharged through the sewage pipe 17, such that the toilet 16 could flush and drain automatically. In this way, not only the secondary flushing of the toilet 16 could be realized, but also reduce the environmental impact such as humidity and temperature by pneumatic control. Furthermore, the manufacturing cost and maintenance cost of the actuator could be reduced, which has strong practicability.

The water valve 4 may be provided between the water source and the toilet 16. The water valve 4 may be communicated with the pneumatic valve assembly. The switch of the water valve 4 is controlled by the pneumatic valve assembly to realize the flushing of the toilet 16. The toilet 16 is provided with a flushing-ring outlet 21 to facilitate the flushing of water along an inner wall of the toilet 16.

The pinch valve 19 may be provided between the sewage valve 15 and the toilet 16, the pinch valve 19 may be communicated with pneumatic valve assembly, and is controlled by the pneumatic valve assembly, such that the sewage in the toilet 16 is pumped into the sewage tank 15. The pinch valve 9 may be made of rubber. The pinch valve 9 may include a connecting part 22 and a rubber sleeve 24. A channel 25 and an air chamber 23 may be defined in the connecting part 22. The channel 25 may have a port P (also called as a first port) and a port A (also called as a second port) opposite to the port P. The air chamber 23 may be around the channel 25 and communicated with the channel 25. The rubber sleeve 24 is arranged in the air chamber 23 and separates the air chamber 23 from the channel 25. Under a normal condition, the port P of the connecting part 22 is communicated with a port A (as shown in FIG. 2). When a port K of the connecting part 22 starts ventilation, air pressure in the air chamber 23 increases, which could cause the rubber sleeve 24 to expand until the rubber sleeve 24 is closed, that is, the channel 25 is blocked. At this time, the port P and the port A are disconnected, and the sewage in the toilet 16 is not discharged into the sewage tank 15. The pressure at the port K equals the pressure at the port P Plus 0.2 MPa.

The present disclosure may include the following conditions in actual use:

1) The Initial State a) The mechanical valve 1 is in a blocking position in a normal state, the mechanical valve 1 does not receive control signal, in this condition, a port P and a port A of mechanical valve 1 are disconnected. There is no signal received by a port KR of the second pneumatic valve 2.

b) The seventh pneumatic valve 8 may be in the through flow position in the normal state. Gas in the first pressure tank 18 may enter the pinch valve 9 through the seventh pneumatic valve 8. The pinch valve 9 may be switched to the blocking position when receiving controlling signal K. In this time, the toilet 16 is disconnected to the port b of the sewage tank 15.

c) The tenth pneumatic valve 12 is in a through flow position in the normal state. The gas in the first pressure tank 18 may flow through the port P of the tenth pneumatic valve 12, the port A of the tenth pneumatic valve 12, and enter into the eleventh pneumatic valve 13. The eleventh pneumatic valve 13 is switched to be in the blocking state after receiving the controlling signal K. In this condition, a port d of the sewage tank 15 is disconnected from the sewage pipe 17.

d) The eighth pneumatic valve 10 is in the through flow position in the normal state. The vacuum tank 20 is communicated with the port c of the sewage tank 15, and is configured to provide vacuum compensation for the sewage tank 15. The vacuum tank 20 defines a runner therein, which may have a function of buffer, and a function of providing vacuum compensation quickly for the sewage tank 15 when the system is reset, so as to quickly prepare for a second use.

In the initial state, the pressure in the second pressure tank 19 ranges from 0.35 MPa to 0.4 MPa, the pressure in the first pressure tank 18 equals to the sum of the pressure in the second pressure tank 19 and 0.2 MPa.

2) The System Starting to Operate a First Flushing a) A button H of the mechanical valve 1 is pressed, the port P of the mechanical valve 1 is connected with the port A, the gas enters the port KR of the second pneumatic valve 2 through the port A of the mechanical valve 1, so that the port P of the second pneumatic valve 2 is connected with the port A of the second pneumatic valve 2. The gas in the first pressure tank 18 enters the port P of the fourth pneumatic valve 5 through the second pneumatic valve 2. At this time, the port P of the fourth pneumatic valve 5 is disconnected from the port A of the fourth pneumatic valve 5, and the fourth pneumatic valve 5 is in the blocking position.

b) Part of the gas passes through port A of the second pneumatic valve 2 and enters the first regulating valve 501 as a control signal K. When the first regulating valve 501 will generate the control signal K when reaching the set regulating time.

c) During the regulation of the first regulating valve 501, when the set regulating time is not reached, part of the gas enters the third pneumatic valve 3 through the port A of the second pneumatic valve 2. In the normal state, the port P and the port A of the third pneumatic valve 3 are connected, and the gas enters the water valve 4 through the port A of the third pneumatic valve 3. The water valve 4 is in the blocking position when in the normal state, when the water valve 4 receives the control signal K, the port P and the port A of the water valve 4 are communicated with each other, and the water from the water source enters the flushing-ring outlet 21 of the toilet 16 through the water valve 4 for flushing.

d) The eighth pneumatic valve 10 is in the through flow position when in the normal state, when the gas from the first pressure tank 18 enters the eighth pneumatic valve 10, the eighth pneumatic valve 10 receives the control signal K, the port P of the eighth pneumatic valve 10 is disconnected from the port A of the eighth pneumatic valve 10, and the vacuum tank 20 is disconnected from the port c of the sewage tank 15. At this time, the sewage tank 15 maintains in a vacuum/negative pressure state.

3) Sewage in the Toilet Being Pumped into the Sewage Tank a) After the first regulating valve 501 reaches the preset regulating time, the fourth pneumatic valve 5 is turned on to be in the through flow position after receiving the control signal K. The gas enters the port P of the fifth pneumatic valve 6 through the port A of the fourth pneumatic valve 5. At this time, the port P of the fifth pneumatic valve 6 is communicated with the port A of the fifth pneumatic valve 6. The third pneumatic valve 3 receives the control signal K, and the port P of the third pneumatic valve 3 is controlled to be disconnected from the Port A of the third pneumatic valve 3. The water valve 4 loses the control signal, so that the port P of the water valve 4 is disconnected from the port A of the water valve 4, and the water source is cut off, and the flushing action ends.

b) Part of the gas, as a control signal, enters the seventh pneumatic valve 8 through the port A of the fifth pneumatic valve 6. After receiving the control signal K, the port P of the seventh pneumatic valve 8 disconnects from the port A thereof, the pinch valve 9 loses the control signal, which turns on the pinch valve 9. The toilet 16 is connected with the port b of the sewage tank 15, so that the sewage in the toilet 16 is pumped into the sewage tank 15.

c) The gas passes through the port A of the fifth pneumatic valve 6 and enters the port P of the sixth pneumatic valve 7. At this time, the port P of the sixth pneumatic valve 7 is disconnected from the Port A thereof. Part of the gas enters the second regulating valve 701 as a control signal K. The second regulating valve 701 sets the regulating time and generates a control signal K. At this time, the sixth pneumatic valve 7 does not receive a control signal.

4) Flushing for the Second Time a) After the second regulating valve 701 reaches the set regulating time, the sixth pneumatic valve 7 receives the control signal K, so that the port P of the sixth pneumatic valve 7 is connected with the port A thereof, the port KL of the fifth pneumatic valve 6 receives the control signal, the port P of the fifth pneumatic valve 6 is connected with the port B, and the port P of the fifth pneumatic valve 6 is disconnected from the port A. At this time, the pneumatic circuit switching is performed, and air circuit directly connected with the rear end of the port A of the fifth pneumatic valve 6 releases the pressure from the port R of the fifth pneumatic valve 6.

b) At this time, the third pneumatic valve 3 loses the control signal K, the third pneumatic valve 3 resets to the normal state, which is in a through flow position, and the port P of the third pneumatic valve 3 and the port A thereof are connected. The water valve 4 receives the control signal K, and the water from the water source enters the toilet 16 to realize the secondary flushing.

c) At this time, the seventh pneumatic valve 8 loses the control signal K, the eighth pneumatic valve 10 resets, the port P of the seventh pneumatic valve 8 is connected with the port A thereof. The gas of the first pressure tank 18 enters the pinch valve 9 through the seventh pneumatic valve 8. The pinch valve 9 receives the control signal K, the port P of the pinch valve 9 is disconnected from the port A of the pinch valve 9, and the toilet 16 is disconnected from the sewage tank 15. The residual gas in the sixth pneumatic valve 7 is discharged into the atmosphere through the port R of the sixth pneumatic valve 7 to release the pressure.

5) Entering Discharging Mode a) The gas enters the twelfth pneumatic valve 14 through the port B of the fifth pneumatic valve 6. After receiving the control signal K, the port P of the twelfth pneumatic valve 14 is communicated with the Port A thereof, the gas in the second pressure tank 19 enters the port a of the sewage tank 15, and the pressure in the sewage tank 15 increases.

b) The gas enters the tenth pneumatic valve 12 through the port B of the fifth pneumatic valve 6. After receiving the control signal K, the port P of the tenth pneumatic valve 12 is disconnected from the Port A of the tenth pneumatic valve 12. The Eleventh pneumatic valve 13 does not receive the control signal. The eleventh pneumatic valve 13 is switched to be in the through flow position. The Port d of the sewage tank 15 is communicated with the sewage pipe 17, so that the sewage in the sewage tank 15 is discharged from the sewage pipe 17 through the eleventh pneumatic valve 13.

c) The gas passes through the port B of the fifth pneumatic valve 6 to port P of the ninth pneumatic valve 11. At this time, the port P of the ninth pneumatic valve 11 is disconnected from the port A thereof, and the ninth pneumatic valve 11 is in the disconnected state. Part of the gas enters the third regulating valve 1101 as the control signal K. the regulating time is set through the third regulating valve 1101 and the control signal K is generated. At this time, the ninth pneumatic valve 11 does not receive a control signal.

6) Entering Reset Mode a) After the third regulating valve 1101 reaches the set regulating time, the ninth pneumatic valve 11 receives the control signal K, the port P of the ninth pneumatic valve 11 is connected with the port A thereof, and the gas enters the port KL of the second pneumatic valve 2 through the port A of the ninth pneumatic valve 11, so that the port P of the second pneumatic valve 2 is disconnected from the port A thereof. Air circuit directly connected with the rear end of the port A releases the residual pressure through the port R of the second pneumatic valve 2, and the second pneumatic valve 2 is reset. At this time, the gas of the first pressure tank 18 does not pass through the second pneumatic valve 2, the gas does not enter the water valve 4 through the third pneumatic valve 3, and the water valve is reset, the water valve is in the blocking position. The eighth pneumatic valve 10 does not receive the control signal, and the eighth pneumatic valve 10 is reset, so that the vacuum tank 20 is communicated with the port c of the sewage tank 15. The gas does not enter the fourth pneumatic valve 5, the gas does not enter the first regulating valve 501, the fourth pneumatic valve 5 loses the control signal, and fourth pneumatic valve 5 is reset and disconnected.

b) At the same time, the gas enters the fifth pneumatic valve 6 through the port A of the ninth pneumatic valve 11, the port KR of the fifth pneumatic valve 6 receives the control signal, and the fifth pneumatic valve 6 is reset, so that the port P of the fifth pneumatic valve 6 and the port A of the fifth pneumatic valve 6 are communicated with each other, to perform the switching. At this time, although the port P of the fifth pneumatic valve 6 and the port A of the fifth pneumatic valve 6 are communicated with each other, there is no gas, the seventh pneumatic valve 8 remains reset, the gas in the first pressure tank 18 enters the pinch valve 9 through the seventh pneumatic valve 8, the pinch valve 9 is closed, and the toilet 16 is disconnected from the port b of the sewage tank 15.

c) At the same time, the tenth pneumatic valve 12 is reset without receiving the control signal and is in the through flow position. The gas of the first pressure tank 18 enters the eleventh pneumatic valve 13 through the tenth pneumatic valve 12, to reset the eleventh pneumatic valve 13, such that the eleventh pneumatic valve 13 is in the blocking position. The Port d of the sewage tank 15 is disconnected from the sewage pipe 17. At this point, the system returns to the initial state to complete the reset.

The description above is only some specific embodiments of the present disclosure, however, the technical features of the present disclosure are not limited to this. Any simple change, equivalent replacement or modification based on the present application to achieve basically the same technical effect is covered by the protection scope of the present application.

What is claimed is:

1. A mechanical control logic actuator for a vacuum toilet, which is free from electric, comprising:

a pneumatic valve assembly, configured to control an air path of the vacuum toilet and a sewage tank;

a vacuum tank, configured to provide vacuum compensation for the sewage tank;

a first pressure tank, configured to provide a power source for the pneumatic valve assembly;

a second pressure tank, configured to feed gas into the sewage tank; and a sewage pipe, configured to discharge sewage in the sewage tank;

wherein the first pressure tank controls the air path to be in a circulation state or in a cut-off state through the pneumatic valve assembly, the vacuum tank provides vacuum compensation for the sewage tank, the sewage in the vacuum toilet is pumped into the sewage tank, the second pressure tank feeds gas into the sewage tank, the sewage tank is pressurized and the sewage is discharged through the sewage pipe, such that the vacuum toilet flushes and drains automatically.

2. The mechanical control logic actuator as claimed in claim 1, wherein a water valve is provided between water source and the vacuum toilet, the water valve is communicated with the pneumatic valve assembly, and is controlled by the pneumatic valve assembly, such that the vacuum toilet flushes.

3. The mechanical control logic actuator as claimed in claim 2, wherein a pinch valve is provided between the sewage valve and the vacuum toilet, the pinch valve is communicated with pneumatic valve assembly, and is controlled by the pneumatic valve assembly, such that the sewage in the vacuum toilet is pumped into the sewage tank.

4. The mechanical control logic actuator as claimed in claim 3, wherein the pneumatic valve assembly comprises a mechanical valve, a second pneumatic valve, a third pneumatic valve, a fourth pneumatic valve, a fifth pneumatic valve, a sixth pneumatic valve, a seventh pneumatic valve, an eighth pneumatic valve, a ninth pneumatic valve, and a tenth pneumatic valve, an eleventh pneumatic valve, and a twelfth pneumatic valve;

the first pressure tank is communicated with the mechanical valve, the second pneumatic valve, the seventh pneumatic valve, and the tenth pneumatic valve;

the mechanical valve is communicated with the second pneumatic valve;

the seventh pneumatic valve is communicated with the pinch valve;

the tenth pneumatic valve is communicated with the eleventh pneumatic valve;

the eleventh pneumatic valve is disposed in the sewage pipe;

the second pneumatic valve is communicated with the fourth pneumatic valve, the third pneumatic valve, and the eighth pneumatic valve;

the fourth pneumatic valve is communicated with the fifth pneumatic valve;

the fifth pneumatic valve is communicated with the third pneumatic valve, the seventh pneumatic valve, the sixth pneumatic valve, the ninth pneumatic valve, and the twelfth pneumatic valve; and the ninth pneumatic valve is communicated with the second pneumatic valve.

5. The mechanical control logic actuator as claimed in claim 4, wherein the third pneumatic valve is communicated with the water valve, and is configured to control the water source.

6. The mechanical control logic actuator as claimed in claim 4, wherein the vacuum tank is communicated with the sewage tank through the eighth pneumatic valve.

7. The mechanical control logic actuator as claimed in claim 4, wherein the second pressure tank is communicated with the sewage tank through the twelfth pneumatic valve.

8. The mechanical control logic actuator as claimed in claim 4, wherein the fourth pneumatic valve is coupled to a first regulating valve.

9. The mechanical control logic actuator as claimed in claim 4, wherein the sixth pneumatic valve is coupled to a second regulator.

10. The mechanical control logic actuator as claimed in claim 4, wherein the ninth pneumatic valve is coupled to a third regulating valve.

11. The mechanical control logic actuator as claimed in claim 3, wherein the pinch valve comprises a connecting part and a rubber sleeve;

the connecting part defines a channel and an air chamber, the channel has a first port and a second port opposite to the first port;

the air chamber is around the channel and communicated with the channel; and the rubber sleeve is arranged in the air chamber and separates the air chamber from the channel;

when the pinch valve is in a normal state, the first port is communicated with the second port; when air pressure in the air chamber increases, the rubber sleeve expands to block the channel, and the first port is disconnected from the second port.

* * * * *